US008348713B2

(12) United States Patent
Groft et al.

(10) Patent No.: US 8,348,713 B2
(45) Date of Patent: Jan. 8, 2013

(54) KNOTTED FILAMENT FLYING DISC

(75) Inventors: Savanna Nichole Groft, Denver, NC (US); Erik Christian Larsen, Jr., Hillsborough, NC (US); Patrick Nicholas Groft, Huntersville, NC (US)

(73) Assignee: PHD Productions LLC, Hillsborough, NC (US)

( * ) Notice: Subject to any disclaimer, the term of this patent is extended or adjusted under 35 U.S.C. 154(b) by 317 days.

(21) Appl. No.: 12/099,545

(22) Filed: Apr. 8, 2008

(65) Prior Publication Data

US 2009/0253339 A1 Oct. 8, 2009

(51) Int. Cl.
*A63H 33/18* (2006.01)

(52) U.S. Cl. ..... 446/46

(58) Field of Classification Search ..... 446/46–48
See application file for complete search history.

(56) References Cited

U.S. PATENT DOCUMENTS

| | | | | |
|---|---|---|---|---|
| 4,223,473 | A | 9/1980 | Brown | |
| 4,279,097 | A | 7/1981 | Walker | |
| 4,737,128 | A | 4/1988 | Moormann et al. | |
| 4,955,841 | A | 9/1990 | Pastrano | |
| 5,078,637 | A | 1/1992 | McFarland | |
| 5,261,846 | A | 11/1993 | Hanna | |
| 5,287,561 | A | 2/1994 | Spector | |
| 5,358,440 | A | 10/1994 | Zheng | |
| 5,630,742 | A | 5/1997 | Honaker | |
| 6,174,214 | B1 | 1/2001 | Cooper | |
| 6,682,384 | B2 * | 1/2004 | Wang | 446/46 |
| 6,939,191 | B1 | 9/2005 | Wu | |
| 2002/0111105 | A1 | 8/2002 | Silverglate | |
| 2003/0232565 | A1 | 12/2003 | Silverglate | |
| 2004/0147347 | A1 * | 7/2004 | Gerak et al. | 473/569 |
| 2007/0278422 | A1 * | 12/2007 | Einhorn et al. | 250/462.1 |
| 2008/0052805 | A1 * | 3/2008 | Syphrit | 2/183 |

OTHER PUBLICATIONS http://www.ecrater.com/product.php?pid=282225.*
http://hookedoncrochet.ecrater.com/product.php?pid=282225.*
Graham, Stacey, "Crochet Gifts to Go!" for Flying Disk Toy, Pampered-Pet Pleasers, pp. 89-92, Copyright 2001 House of White Birches, Berne, Indiana 45711; Dan H. Musselman and Arthur K. Muselman, Library of Congress No. 00-109646, ISBN: 1-882138-68-6, United States of America.
Ladylinoleum (A/K/A/ Regina Rioux), "Monster Crochet: Splat the Supa' Phlat Fly", pp. 1-4, Jul. 7, 2005, http://monstercrochet.blogspot.com/2005/07/splat-supa-phlat-fly.html.
Hooked on Crochet, "Super Crochet Frisbee" and "Rainbow Super Frisbee", pp. 1-3, http://hookedoncrochet.ecrater.com/p/282225/super-crochet-frisbee; Aug. 2, 2006.

* cited by examiner

*Primary Examiner* — Gene Kim
*Assistant Examiner* — Amir Klayman
(74) *Attorney, Agent, or Firm* — Coats & Bennett, P.L.L.C.

(57) ABSTRACT

A flying disc is formed entirely of a knotted filament, such as knotted, stitched, or crocheted filament, which may comprise yarn, rope, or the like. A generally flat, generally circular web, defining a plane, is formed by pulling loops of the filament through other loops to form successive interconnected rows of knots using, e.g., crochet stitches. In one embodiment, the knotting proceeds in a helical pattern from a central portion of the circular web to a peripheral portion, with stitches added to an otherwise uniform stitching pattern as necessary to maintain a generally flat shape to the web. The center of the circular web may comprise knotted filament, or may include a void or hole. A circumferential lip connected to the periphery of the circular web and extending out of the plane of the circular web, at least during flight, is formed by dropping stitches from a uniform stitching pattern as necessary to create the desired shape.

14 Claims, 3 Drawing Sheets

KNOTTED FILAMENT FLYING DISC

FIELD OF THE INVENTION

The present invention relates generally to flying discs, and in particular to a flying disc comprising a continuous web formed by knotting a filament.

BACKGROUND

Flying discs are well known in the art. So many variations of the flying disc have been invented that the U.S. Patent and Trademark Office has dedicated a subclass to them (currently 446/46). The best-known and most popular example of a flying disc—first marketed by Wham-O and currently by Mattel Inc. of El Segundo, Calif.—bears the trademark FRISBEE®. As described in U.S. Pat. No. 3,359,678, "In the usual embodiment the implement is made of a plastic material in a saucer shape with a rim located around the edge of the saucer, the rim having a somewhat greater thickness than the saucer portion of the implement. The rim curves downwardly from the saucer and has a configuration such that the implement when viewed in elevation approximates the shape of an airfoil."

This airfoil shape provided by the circumferential lip of a flying disc extending out of the plane of the circular disc portion, together with gyroscopic stability from the spin imparted to the disc by the thrower, provides lift as the disc flies through a viscous medium, such as air. The lift allows the disc to overcome gravitational attraction nearly equivalent to its own weight, allowing the disc to "fly" a considerable distance. As disclosed in the above-referenced patent, perturbations on the convex (upper) surface of the disc interrupt the smooth flow of air over this surface. This creates a turbulent unseparated boundary layer over the upper surface of the disc, which reduces drag and increases stability in flight. The above-referenced patent discloses forming grooves in the (plastic) upper surface of the flying disc to create this effect.

Flying discs have been manufactured in a variety of variations on the basic shape, and using a wide variety of materials. The classic FRISBEE® is made from rigid plastic. Other flying discs have been formed from a variety of softer materials, such as neoprene, polystyrene, polyurethane foam (e.g., NERF® brand), and similar lightweight and/or deformable materials. Some flying disc designs include a rigid or deformable circumferential lip, with the central expanse of the disc comprising stretched cloth, flexible plastic, carpet, or the like. A variation of flying discs omits the "disk" portion, comprising only a circumferential ring or ring+lip configuration. A notable example of such a ring is marketed by Aerobie, Inc. of Palo Alto, Calif., under the trademark AEROBIE®. In 2003 Erin Hemmings broke the Guinness World Record of the "longest throw of an object without any velocity-aiding feature" by throwing an AEROBIE® ring over a quarter mile (1,333 feet).

Many flying discs formed of "soft" or deformable materials, such as NERF® brand products, are intended and marketed for use indoors. However, while these discs may not break an object, such as a lamp, upon impact, they are still quite likely to tip it over, potentially causing damage. This is due to the linear momentum of the disc in flight, which may be modeled as the disc's mass times its velocity vector, or $\bar{p}=m\bar{v}$. The relatively large mass of foam flying discs means they carry considerable linear momentum, and will impart considerable force to any objects which they strike. Additionally, the foam discs, while more elastic than hard plastic discs, tend to be relatively inelastic in collisions. That is, while a foam disk may deform slightly upon impact, it generally retains its basic shape. Since so little energy is consumed in deforming the disc's shape, the bulk of the energy is transferred to the struck object, e.g., the lamp. Accordingly, most soft or deformable flying discs are not truly well suited for normal use in a typical indoor environment. Rather, a thrower must take extreme care to control the flight path of the disc, and must be careful not to impart too much energy into the throw, with the deleterious consequence of reducing the disc's range.

SUMMARY

According to one or more embodiments described and claimed herein, a flying disc is formed entirely of a knotted filament. The weaving craft crochet is well known in the art. Crochet is one form of knotting, or stitching, a filament such as yarn, rope, or the like to form a flying disc. A generally flat, generally circular web, defining a plane, is formed by pulling loops of the filament through other loops to form successive interconnected rows of knots using, e.g., crochet stitches. In one embodiment, the knotting proceeds in a helical pattern from a central portion of the circular web to a peripheral portion, with stitches periodically added to an otherwise uniform stitching pattern to maintain a generally flat shape to the web. The center of the circular web may comprise knotted filament, or may include a void or hole. A circumferential lip extending from the periphery of the circular web and extending out of the plane of the circular web, at least during flight, is formed by periodically dropping stitches from a uniform stitching pattern.

The circumferential lip extends in flight, via centrifugal force, to form an airfoil that generates lift on the disc. The knotted filament construction provides a rough upper surface to the disc, generating a turbulent unseparated boundary layer over the circular web, reducing drag and increasing stability in flight. The knotted filament flying disc has a very low mass, and hence a low linear momentum in flight, for a given velocity. The knotted filament flying disc is highly elastic in a collision, completely collapsing from a disc-shape upon striking most objects. The low momentum and high elasticity of collision make the knotted filament flying disc uniquely well suited for use indoors. Additionally the disc is well suited for outdoor use.

DETAILED DESCRIPTION

Figure 1:
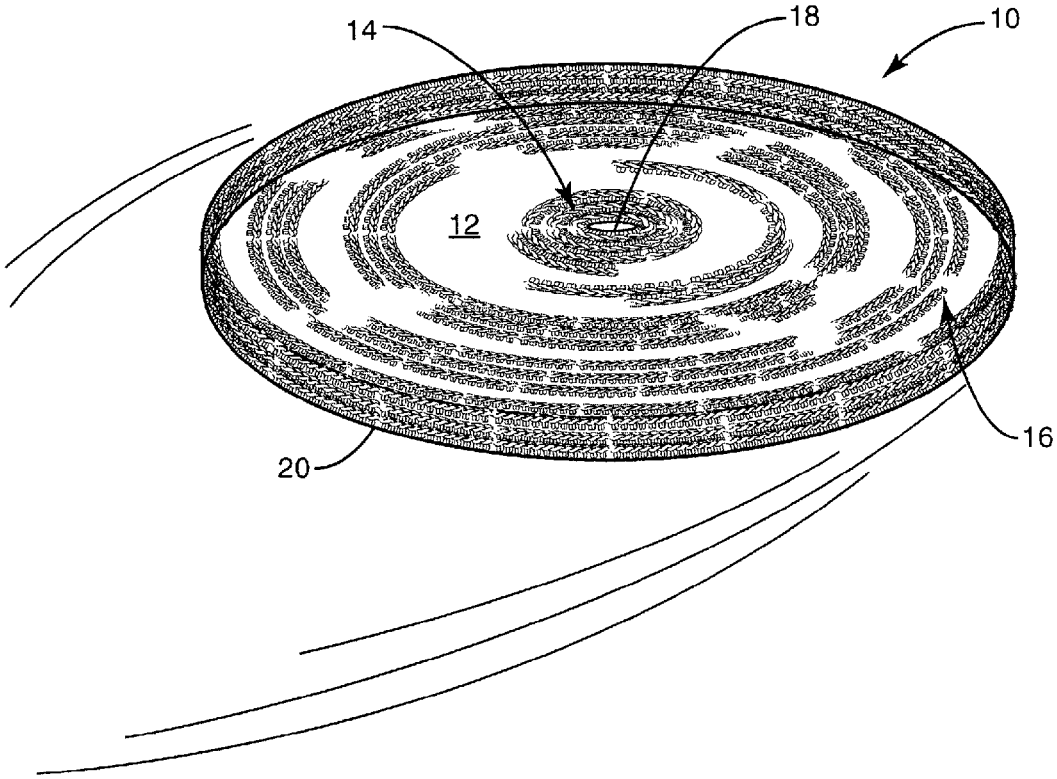
FIG. 1 is a perspective view of a knotted filament flying disc.

FIG. 1 is a perspective view of one embodiment of a knotted filament flying disc 10, viewed from below as the disc is in flight. The disc 10 comprises a generally flat, generally circular web 12, which defines a plane. The circular web 12 includes a central portion 14 and a peripheral portion 16. The central portion 14 may include a void or hole 18. In other embodiments, the entire central portion 14 may comprise knotted filament, without a central hole 18.

Connected to and extending from the peripheral portion 16 of the circular web 12, and extending out of the plane of the circular web 12, is a circumferential lip 20. The lip 20 also comprises knotted filament, and is an integral part of the disc 10. The lip 20 is formed, and forced to extend out of the plane of the circular web 12, by deviating from a uniform knotting or stitching pattern by periodically dropping stitches.

Figure 2:
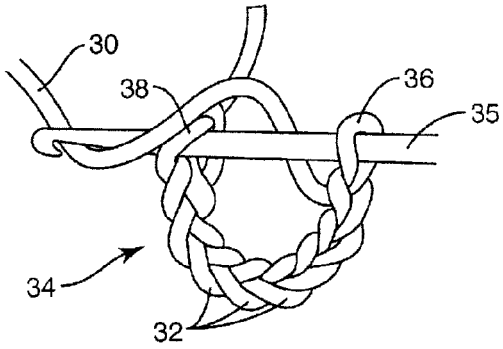
FIG. 2 depicts a series of knots in a circular pattern to begin a circular knotted filament web.

FIG. 2 depicts a filament 30 being formed into a series of interlocking loops 32, forming a circle 34. The filament 30 may be "hooked," or captured, by an implement 35, such as a crochet needle or other device (or a knitter's finger), and pulled through each loop 32 to form a successive loop 32. The circle 34 is formed by pulling the filament 30 through both the first loop 38 and final loop 36. In one embodiment, a compound, circular series of loops 32 begins the formation of the circular web 12. The number of loops 32 in the circle 34 may be varied such that, when tightened, the series of loops 32 forms a tight circle 34, leaving only a small space in the center of the circle 34, which is preferably on the order of the spacing between any stitches in the circular web 12. In this embodiment, the circular web 12 comprises a substantially continuous web of knotted filament 30. Building the circular web 12 proceeds by stitching the filament 30 to the circle 34, outwardly in a helical pattern, as described herein.

Figure 3:
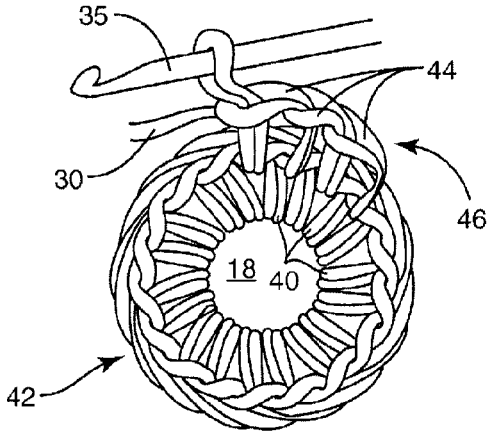
FIG. 3 depicts the formation of a central hole in a flying disc.

FIG. 3 depicts a different manner of beginning the circular web 12. In this embodiment, a series of central loops 40 are formed around a circle of filament (not shown) to define the hole 18 at the center of the circular web 12. The filament forming each central loop 40 is then connected to at least the adjacent loop 40, forming a first circular row 42 of knotted filament 30. The filament is then formed into a generally uniform pattern of stitches 44, connected to the first row 42, forming a second row 46. The knotting proceeds outwardly in a helical pattern to form the circular web 12.

Figure 4:
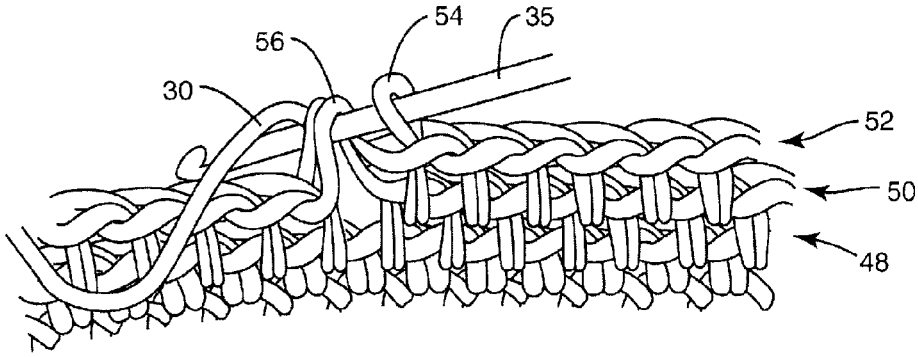
FIGS. 4 and 5 depicts the formation of a stitch in a uniform stitching pattern.
Figure 5:
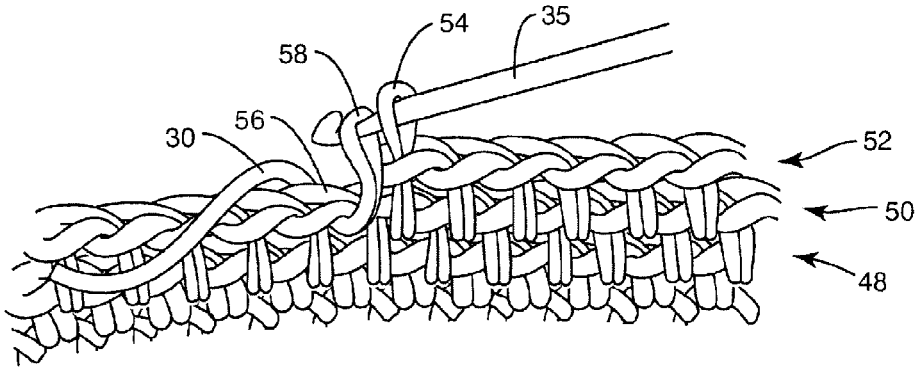

FIGS. 4 and 5 depict, in greater detail, the knotting of filament 30 in a uniform stitching pattern to form a web or fabric. FIG. 4 depicts a plurality of completed rows of knotted filament, ending with rows 48 and 50. In creating row 52, the filament 30 is successively looped through a corresponding knot in the prior row 50, and the immediately previously-formed loop in the current row 52. For example, just prior to the situation depicted in FIG. 4, the knotting implement 35 was inserted through a just-completed loop 54, e.g., as depicted in FIG. 3. The implement 35 is then inserted under a corresponding stitch 56 in the prior row 50, and the filament 30 is captured. As depicted in FIG. 5, the filament is pulled through the corresponding stitch 56 in the prior row 50, creating a new loop 58. The new loop 58 is then pulled through the loop 54, with the implement 35 extracting entirely from the loop 54, leaving only the newly-formed loop 58 on the implement 35, again resembling the configuration depicted in FIG. 3. The process is then repeated.

Note that each newly-formed loop 58 in a row 52 being formed is anchored to (i.e., looped through) precisely one corresponding loop 56 in the prior row 50. This defines a uniform stitching pattern. As used herein, a "uniform stitching pattern" is one in which each stitch on a row being formed is connected to a corresponding stitch in the immediately prior row.

The use of a uniform stitching pattern is well known in the knitting and crocheting arts—indeed, most flat webs or fabrics are formed using a uniform stitching pattern. It is also well known that, in many cases, deviating from a uniform stitching pattern by "adding" stitches to or "dropping" stitches from a uniform pattern may cause the fabric being formed to "bunch up," or deviate from a generally flat, two-dimensional expanse. Such added or dropped stitches are often mistakes, and the resulting bunched fabric is considered a defect. In some cases, added or dropped stitches are a carefully designed feature of a stitching pattern, and are used to create fabrics having predetermined three-dimensional shape, e.g., performing the function of a dart in a sewn garment.

Most two-dimensional webs formed by knotting filament employ a uniform stitching pattern and uniform, or straight, rows of stitches, each row connected to the next. However, when stitching a filament in a circular pattern, connecting each successive concentric row to the next innermost row, a uniform stitching pattern will not yield a flat web. This is because the length of each concentric row, or ring, increases with its distance from the center, according to the formula $C=2\pi r$ where C is the length of a concentric row, and r is its distance from the center. Accordingly, stitches must be periodically added to an otherwise uniform stitching pattern in each successive concentric row, to maintain a flat web. The same is generally true of a web knotted in a helical pattern.

Figure 6:
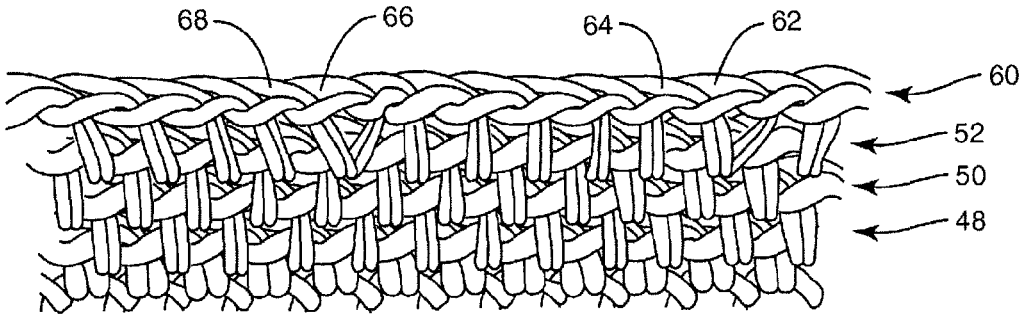
FIG. 6 depicts added stitches in an otherwise uniform stitching pattern.

The circular web 12 of the flying disc 10 of the present invention is formed in one embodiment by knotting filament 30 in a helical pattern, using a generally uniform stitching pattern with the exception that stitches are periodically added to maintain a generally flat shape to the web. FIG. 6 depicts a row 60 having added stitches 64, 68 in row 60. Rows 48, 50, 52 employ a uniform stitching pattern (at least in the region depicted in FIG. 6). That is, each stitch in a successive row 52, 50, is anchored to precisely one corresponding stitch in a prior row 50, 48, respectively. To allow for a greater length of row 60, both a uniform stitch 62 and an added stitch 64 connect to the same corresponding stitch in the prior row 52. Similarly, both a uniform stitch 66 and an added stitch 68 connect to the same corresponding stitch in the prior row 52.

As used herein an "added" stitch is a second stitch in a row being formed that is connected to the same corresponding stitch in the immediately prior row as a first stitch. In one embodiment, a stitching pattern for forming the circular web 12 of a flying disc 10 comprises adding one stitch in a plurality of uniform stitches, as necessary for maintaining the circular web 12 in a generally flat, or planar, shape. The frequency of adding stitches to an otherwise uniform stitching pattern may change as a function of the distance of a row from the center of the circular web.

Conversely, the circumferential lip 20 of the flying disc 10 of the present invention is formed in one embodiment by continuing to knot or stitch filament 30 in a helical pattern, using a generally uniform stitching pattern. Without the added stitches, as the length of each successive row grows, the periphery of the circular web 12 will begin to curve away from a planar shape. To accelerate this curvature, stitches may be dropped from an otherwise uniform stitching pattern, as necessary to form a circumferential lip 20 generally normal to the plane of the circular web 12. Note that the circumferential lip 20 may be formed in either direction—that is, it may curve either "up" or "down" from the circular web 12.

Figure 7:
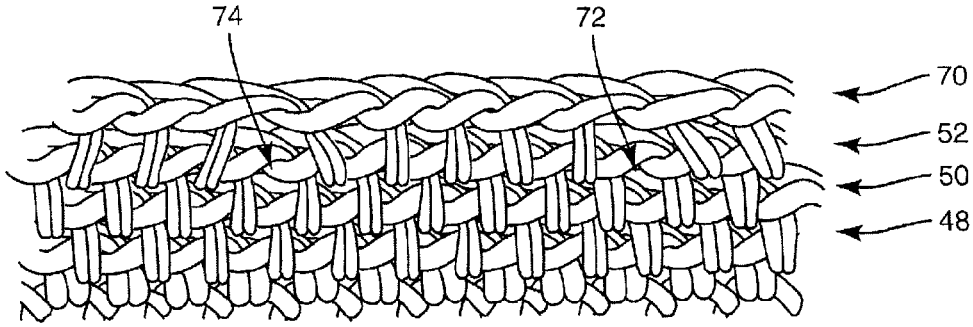
FIG. 7 depicts dropped stitches in an otherwise uniform stitching pattern.

FIG. 7 depicts a row 70 dropping stitches at prior-row 52 positions 72 and 74. Rows 48, 50, 52 employ a uniform stitching pattern (at least in the region depicted in FIG. 7). That is, each stitch in a successive row 52, 50, is anchored to precisely one corresponding stitch in a prior row 50, 48, respectively. To force row 70 to have a shorter length than row 52, forcing the web in the region of the circumferential lip 20 to deviate from the plane of the circular web 12, no stitch is connected to stitch positions 72, 74 in the prior row 52. That is, the stitches that would be anchored to these positions in a uniform stitching pattern are dropped. As used herein, "dropping" a stitch means to leave a stitch in an immediately prior row without a corresponding stitch being connected thereto in a row being formed.

In one embodiment, once the "shoulder" of the circumferential lip 20, or its curvature from the plane of the circular web 12, is formed, a uniform stitching pattern (or even a stitching pattern that occasionally adds a stitch to an otherwise uniform pattern) may be employed to build up the height of the circumferential lip 20 extending generally normal to the plane of the circular web 12.

In one embodiment, the filament 30 may comprise a "worsted weight" four-ply cotton yarn of approximately ⅛ inch diameter, such as that available under the Sugar N Cream® and Lion Cotton® brands. The knots may be formed with the aid of a G or H size crochet hook. The circular web 12 may be formed by knotting the filament 30, adding stitches as necessary to maintain a flat shape, until the diameter is between 7.5 and 9.5 inches. Three to four rows of knots may then be added without adding stitches, followed by two rows dropping, e.g., every fifth stitch. These parameters are exemplary only, and are not limiting.

Flying discs 10 according to the present invention may be formed of any suitable filament 30, such as yarn, twine, or a variety of pliant plastics formed as filaments. The filament 30 may be altered, e.g., to change its color, by severing a first filament 30 and tying to it a second filament 30, as is well known in the knitting arts. Alternatively, first and second filaments 30, each of a different color, shade, texture, or the like, may be utilized. Knots are formed with the first filament 30 in such a manner that the second filament 30 is hidden by the knots—that is, the second filament 30 lies beneath a row of stitches and cannot be seen. A color change may then be effected by forming knots of the second filament 30, while "hiding" the first filament 30 by positioning it under the knots. Various patterns may be knotted into the flying disc 10 by changing filament colors according to predetermined patterns. In one embodiment, a filament 30 having photo luminescent ("glow in the dark") properties is used to form at least a portion of the flying disc 10. In one embodiment, indicia may be added to the circular web 12, such as by embroidery, heat transfer, screen printing, woven labels, or any other method known in the art.

In one embodiment, the multi-filament technique described above is employed—whether the first and second (and/or more) filaments 30 are the same or different—to form a flying disc 10 having a greater mass, and hence greater linear momentum. This embodiment generally flies further than single-filament embodiments. However, the multi-filament embodiment may also impart a higher force to a struck object, and accordingly may find greater utility in outdoor use.

The knotted filament flying disc 10 of the present invention exhibits numerous benefits over flying discs known in the art. The knotted filament flying disc 10 is lightweight, and hence carries relatively little linear momentum in flight, particularly compared to prior art flying discs formed from plastic and the like. The knotted filament flying disc 10 is characterized by a very high elasticity of collision. These properties combine to make the knotted filament flying disc 10 uniquely suited for flight in any environment, indoor or outdoor, where tipping objects or striking people or animals is a concern. The knotted filament flying disc 10 is very soft, and makes an excellent toy for young children. The knotted filament flying disc 10 folds or crumples to a very compact shape when not in use, and may be easily transported, such as in one's pocket.

The knotted filament flying disc 10 may be formed entirely of simple, inexpensive material, such as yarn, and requires no manufacturing tooling, such as injection molding equipment, for manufacture. The knotted filament flying disc 10 may be customized to, e.g., a sports team, simply by employing the team colors, without the expense of licensing and affixing a logo. Due to these numerous advantages, and the invention's inherent novelty, the knotted filament flying disc 10 may find particular application as a company, sports team, or any other entity's promotional item.

As used herein, knotted filament refers to a web or fabric comprising a series of connected knots formed in one or more filaments 30 such as yarn, rope, or the like. Stitches are a subclass of knots; crochet stitches are a subclass of stitches. A knotted filament may be formed by tying or stitching knots in one or more filaments 30, by hand or with the use of one or more implements 35 such as a crochet hook, knitting needles, or the like. A knotted filament is distinct from cloth, which is woven from threads. A stitching pattern refers to a sequence or order of stitches, and their attachment to another row of stitches.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A hand thrown device comprising a flying disc formed of a crocheted filament, the flying disk not encompassing an article of apparel, comprising:

a circular web foldable or deformable into a variety of shapes when not in flight, and assuming a generally flat, generally circular shape when the disc is thrown with a spinning motion, the web formed of a filament crocheted in a helical pattern; and a circumferential rim assuming a folded position adjacent a peripheral portion of the circular web when not in flight, and extending out of the plane of the circular web and forming an airfoil shape providing lift when the disc is thrown with a spinning motion, the rim formed of a filament crocheted in a helical pattern wherein stitches are dropped from the stitching pattern so as to force the lip out of the plane of the circular web.

2. The flying disc of claim 1 wherein the circular web is a substantially continuous expanse of knotted filament.

3. The flying disc of claim 1 further comprising a central void in the center of the circular web.

4. The flying disc of claim 1 wherein the knotted filament comprises a plurality of filaments, one which is knotted in a first position and the others of which are obscured from view at the first position by the knotted filament.

5. The flying disc of claim 4 wherein a different filament is knotted in a second position.

6. The flying disc of claim 4 wherein the plurality of filaments have different properties.

7. The flying disc of claim 6 wherein the different property is color.

8. The flying disc of claim 6 wherein the different property is photoluminescence.

9. A hand thrown device comprising a flying disc not encompassing an article of apparel, comprising:

a generally flat, generally circular crocheted web defining a plane, wherein the crochet stitching pattern in the circular crocheted web comprises a helical pattern wherein stitches are added to an otherwise uniform stitching pattern so as to maintain a generally planar shape; and a crocheted circumferential lip connected to the periphery of the circular web and extending out of the plane of the circular web at least during flight, the lip crocheted with a helical pattern wherein stitches are dropped from the stitching pattern so as to force the lip out of the plane of the circular web.

10. A method of making a hand thrown device entirely from a filament, the hand thrown device comprising a flying disc not encompassing an article of apparel, comprising:

forming a series of knots in one or more filaments to define a circular row of knots;

forming successive rows of knots, each knot in a row attached to an adjacent knot in the same row and to a knot in the prior row, to form a generally flat, generally circular web of knotted filament, wherein the knots form a helical pattern;

adding knots to an otherwise uniform pattern in forming the circular web, so as to maintain the web in a generally planar shape; and at a peripheral portion of the circular web, dropping knots from the pattern to form a circumferential lip extending out of the plane of the circular web at least when the flying disc is in flight.

11. A hand thrown device comprising a flying disc not encompassing an article of apparel, comprising:

web means formed from a knotted filament crochet stitched in a first pattern for assuming a generally planar position when the flying disc is in flight, and for deforming from the planar position when the flying disc strikes an object or is not in flight; and lip means formed from the knotted filament crochet stitched in a different second pattern circumferentially connected to the web means for extending out of a plane of the web means and for creating an airfoil and providing lift when the flying disc is in flight.

12. The flying disc of claim 11 wherein the knotted filament comprises a plurality of filaments.

13. The flying disc of claim 12 wherein at least two of the filaments are different colors.

14. The flying disc of claim 12 wherein at least one of the filaments is photoluminescent.

* * * * *